US011510517B2

(12) United States Patent
McLean et al.

(10) Patent No.: US 11,510,517 B2
(45) Date of Patent: Nov. 29, 2022

(54) APPARATUS FOR SECURE STORAGE AND ATTACHMENT TO EXISTING STRUCTURES

(71) Applicant: Porchie LLC, Layton, UT (US)

(72) Inventors: Daniel Todd McLean, Layton, UT (US); Stephen B. Swensen, Vineyard, UT (US)

(73) Assignee: PORCHIE LLC, Layton, UT (US)

( * ) Notice: Subject to any disclaimer, the term of this patent is extended or adjusted under 35 U.S.C. 154(b) by 0 days.

(21) Appl. No.: 17/189,122

(22) Filed: Mar. 1, 2021

(65) Prior Publication Data

US 2021/0361104 A1 Nov. 25, 2021

Related U.S. Application Data

(60) Provisional application No. 63/078,183, filed on Sep. 14, 2020, provisional application No. 62/982,773, filed on Feb. 28, 2020.

(51) Int. Cl.
*A47G 29/20* (2006.01)
*A47G 29/14* (2006.01)

(52) U.S. Cl.
CPC ..... *A47G 29/20* (2013.01); *A47G 29/141* (2013.01); *A47G 2029/144* (2013.01)

(58) Field of Classification Search
CPC ..... A47G 29/20; A47G 29/141; A47G 2029/144; B65D 7/26; B65D 9/14; B65D 15/24; B65D 11/1853; B65D 21/086
USPC ..... 232/19, 38; 220/6, 666
See application file for complete search history.

(56) References Cited

U.S. PATENT DOCUMENTS

| | | | | |
|---|---|---|---|---|
| 1,673,769 | A * | 6/1928 | Graham | G07C 13/02 220/6 |
| 3,032,253 | A | 5/1962 | Younger | |
| 4,944,422 | A | 7/1990 | Aurness et al. | |
| 5,149,153 | A | 9/1992 | Drewry et al. | |
| 8,333,279 | B2 | 12/2012 | Veiseh et al. | |
| 10,143,321 | B2 * | 12/2018 | Hippert | A47G 29/20 |
| 10,321,780 | B1 * | 6/2019 | James | A47G 29/141 |
| 10,383,471 | B1 | 8/2019 | Barnes et al. | |
| 10,537,196 | B1 | 1/2020 | Macpherson | |
| 10,743,694 | B2 * | 8/2020 | Raphael | A47G 29/20 |
| 11,026,531 | B2 * | 6/2021 | Campodonico | A47G 29/20 |
| 11,109,705 | B2 * | 9/2021 | Raphael | A47G 29/141 |
| 2001/0045449 | A1 | 11/2001 | Shannon | |
| 2013/0077896 | A1 * | 3/2013 | Wiley | B65D 33/28 383/86.2 |

(Continued)

FOREIGN PATENT DOCUMENTS

WO 2019222623 A1 11/2019

OTHER PUBLICATIONS

PCT/US2021/020344 , International Search Report and Written Opinion, dated May 21, 2021, 17 pages.

*Primary Examiner* — William L Miller
(74) *Attorney, Agent, or Firm* — Stoel Rives LLP

(57) ABSTRACT

A secure, lockable folding storage box is disclosed herein. The storage box may attach to doors or walls. The storage box and fastening mechanism is adjustable to accommodate doors of various sizes. The storage box may also be mounted to any fixed or mobile structure. The storage box may be remotely locked, or unlocked, and/or have a programmable key access code interface.

13 Claims, 15 Drawing Sheets

(56) References Cited

U.S. PATENT DOCUMENTS

| | | | | |
|---|---|---|---|---|
| 2016/0068306 | A1* | 3/2016 | Heinz | A47G 29/141<br>220/6 |
| 2017/0127868 | A1* | 5/2017 | Adewuyi | A47G 29/22 |
| 2017/0188737 | A1* | 7/2017 | Hippert | A47G 29/20 |
| 2017/0286905 | A1 | 10/2017 | Richardson et al. | |
| 2018/0296016 | A1* | 10/2018 | Teoh | A47G 29/20 |
| 2019/0225375 | A1 | 7/2019 | Sena | |
| 2019/0350398 | A1* | 11/2019 | Raphael | A47G 29/141 |
| 2020/0107663 | A1* | 4/2020 | Eivaz | A47G 29/141 |
| 2020/0383508 | A1* | 12/2020 | Arif | A47G 29/20 |
| 2021/0127880 | A1* | 5/2021 | Raphael | A47G 29/20 |

* cited by examiner

APPARATUS FOR SECURE STORAGE AND ATTACHMENT TO EXISTING STRUCTURES

RELATED APPLICATIONS

This application claims priority to U.S. Provisional Patent Application No. 62/982,773 filed on Feb. 28, 2020 and U.S. Provisional Patent Application No. 63/078,183 filed on Sep. 14, 2020, both of which are incorporated by reference herein in their entirety.

COPYRIGHT NOTICE

©2021 Porchie LLC. A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR § 1.71(d).

TECHNICAL FIELD

The present invention relates to the security devices for secure storage of packages in an open area. More, particularly, the invention relates to devices for unsecured deliveries to homes, apartment buildings, businesses, and any other unsecured locations.

BRIEF DESCRIPTION OF THE DRAWINGS

Some embodiments of the present invention are illustrated as an example and are not limited by the figures of the accompanying drawings in which the like references may indicate similar elements and in which.

BACKGROUND

Figure 1A:
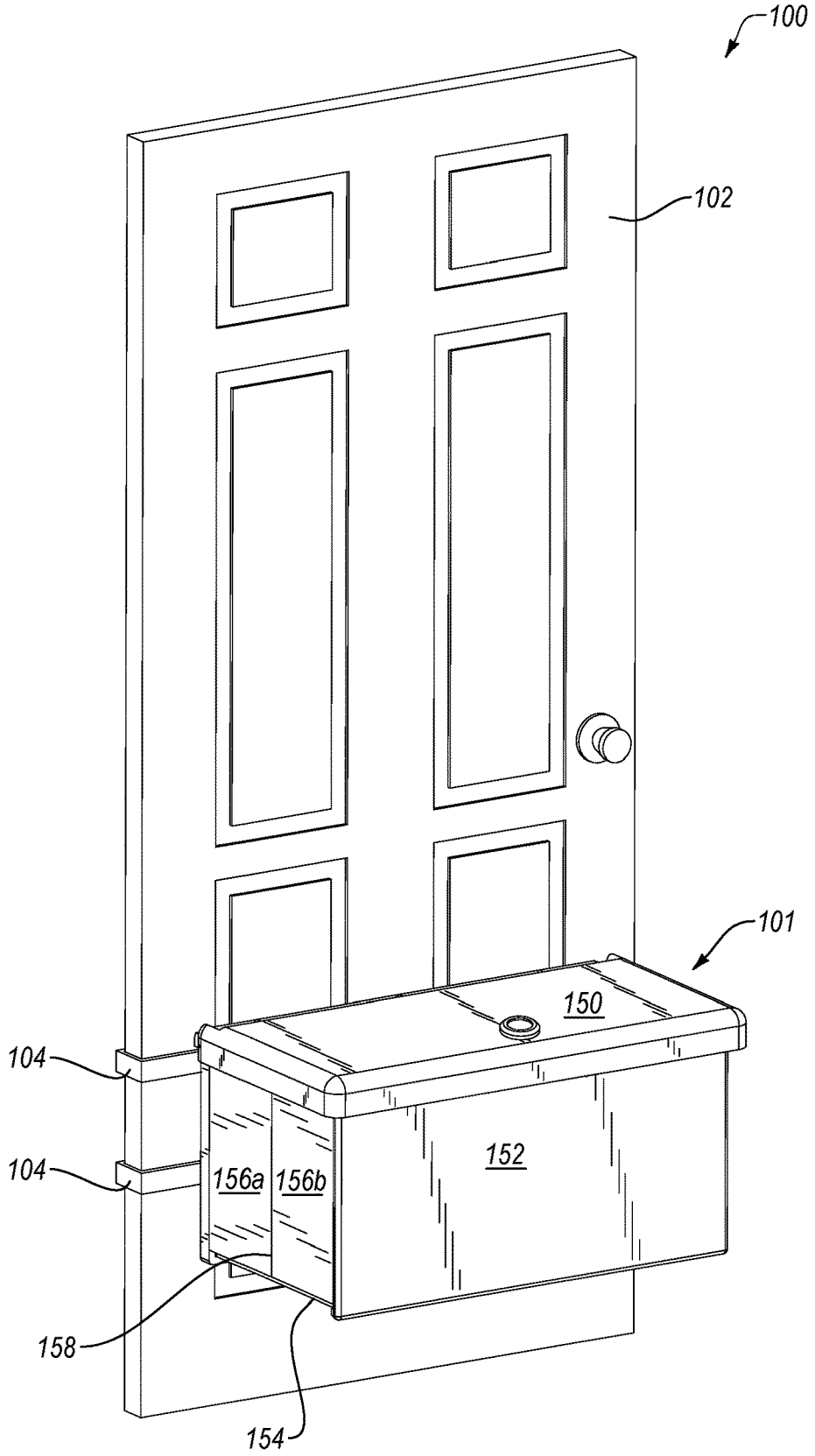
FIG. 1A depicts a perspective view of a storage box system attached to a door.

Door front or drop off deliveries from couriers and postal services are currently subject to a high theft volume. Conventional systems do not allow for a universal attachable locking enclosure to secure the packages after delivery. Proof of delivery systems rely on manual photographs of packages that are taken by a courier. This is only viable at the moment of delivery and offers no security for the product after delivery. Therefore, a need exists in the courier delivery system for a secure attachment structure that universally attaches to all doors and other like objects or structures. It would be an advancement in the art to provide an attachment structure with secure storage that allows for remote unlocking.

DETAILED DESCRIPTION OF THE INVENTION

The present invention comprises a secured lockable folding storage box. This universal box has the ability to attach to any door, or existing structures. The folding box clamping system and mechanical design is adjustable to accommodate doors of all sizes. The box may also be mounted to any fixed mobile structure as well. The storage system may include a video monitoring system connected via bluetooth and/or wi-fi. This may include one camera inside the enclosure and one outside. An outside camera may also be used as a continuous front door video monitor. The box may also have the ability to be remotely locked, or unlocked, and/or have a programmable key access code interface.

The terminology used herein is for the purpose of describing particular embodiments only and is not intended to be limiting of the invention. As used herein, the term "and/or" includes any and all combinations of one or more of the associated listed items. As used herein the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence of addition of the on or moe other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New attachable folding secure storage devices, apparatuses, and methods are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification and is not intended to limit the invention to the specific embodiments illustrated by the figures or description below. The present invention will now be described by referencing the appended figures representing preferred embodiments.

FIG. 1A depicts a perspective view of a storage system 100 that includes an embodiment of a storage box 101. The storage box 101 is configured to be removably attached to a door 102. The storage box 101 includes one or more clamping arms 104 that attach to the door 102. The storage box 101 may be formed of various materials including plastics, rubber, foam, metal alloys, such as aluminum, wood and the like. A clamping arm 104 may be formed of various materials including metal alloys. The storage box 101 includes a top wall or lid 150 that pivots to allow access to a storage box interior (not shown). The storage box 101 includes a front side 152 and a sidewall 154. The storage box 101 further includes an opposing side wall (not shown). The sidewall 154 includes first and second side wall segments 156*a*, 156*b* that are pivotally attached to one another by a hinge 158. The opposing side wall is similarly configured to the sidewall 154.

The storage box 101 may have an exterior surface that is colored and/or decorated to complement its appearance. The storage box 101 may be colored to blend in or camouflage with the door 102 or other surface area. The storage box system 100 may include an interior camera (not shown) and an exterior camera (not shown) for monitoring of packages and or deliveries.

Figure 1B:
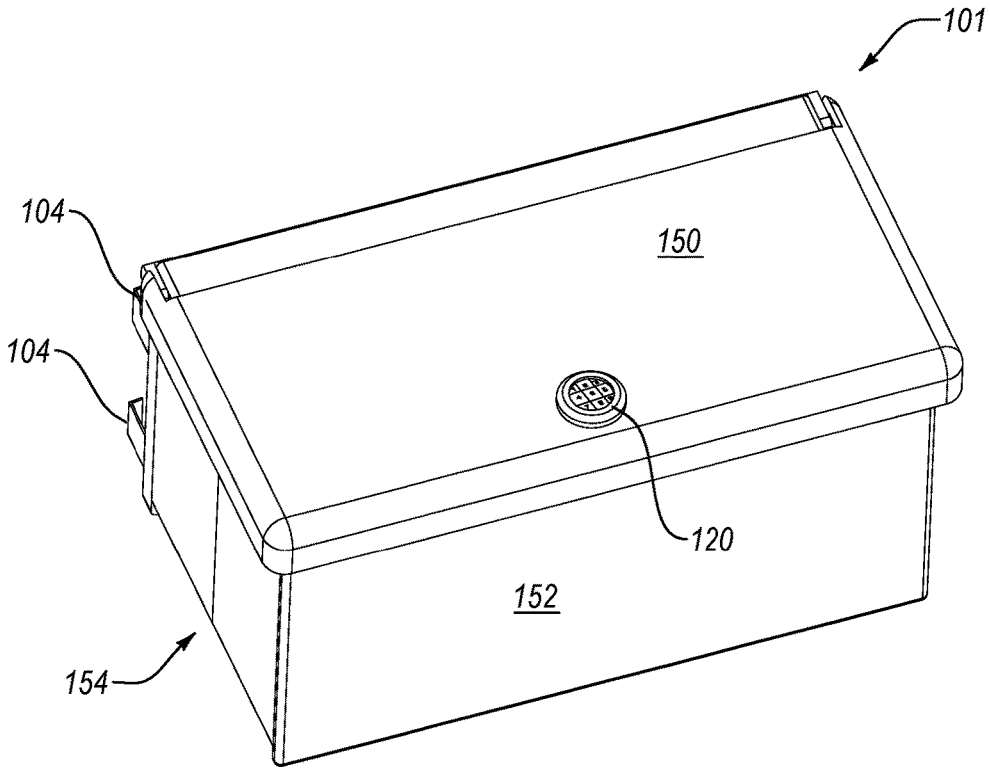
FIG. 1B depicts a front perspective view of the storage box system of FIG. 1A.

FIG. 1B depicts a perspective view of the storage box 101. A locking mechanism 120 secures the position of the top wall 150 relative to the sidewall 154 and front side 152.

Figure 1C:
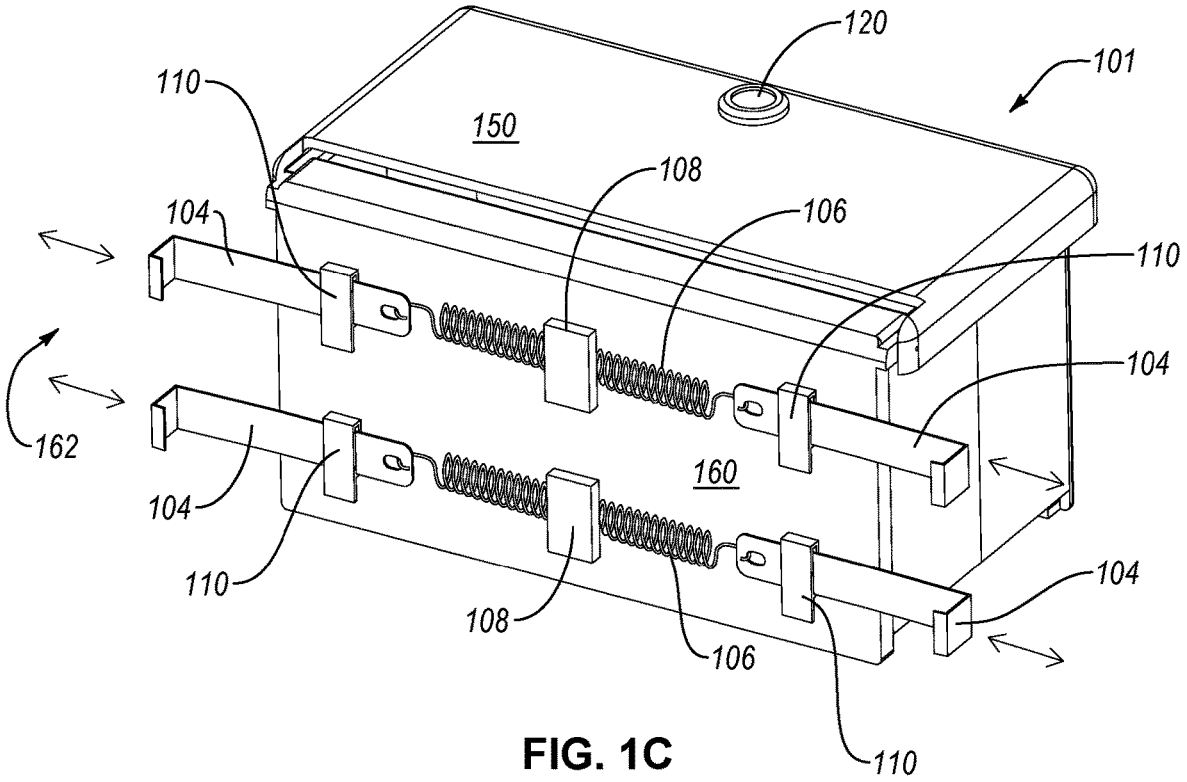
FIG. 1C depicts a rear perspective view of the storage box system of FIG. 1A.

FIG. 1C illustrates a perspective view of the back of the storage box 101. The storage box 101 includes a back wall 160 and the top wall 150 is pivotally attached to the top of the back wall 160. The storage box 101 includes one or more bases 108 secured to the back wall 160. A spring 106 is secured to a corresponding base 108 and the spring 106 attaches to a corresponding clamping arm 104. Each clamp 104 is held in place by a corresponding guide 110. A guide 110 is secured to the back wall 160 and receives a corresponding clamping arm 104. The clamping arms 104 are tensioned by corresponding springs 106. As can be appreciated, at least two clamping arms 104 are used to secure the storage box 101 to opposing sides of a door 102. As illustrated, four clamping arms 104, four corresponding springs 106, and four corresponding guides 110 are used. Depending on the size of the storage box 101, two, four, six, or even eight clamping arms 104 may be used. The combination of the clamping arms 104, springs 106, bases 108, and guides 110 may be collectively referred to herein as the fastening mechanism 162.

Figure 1D:
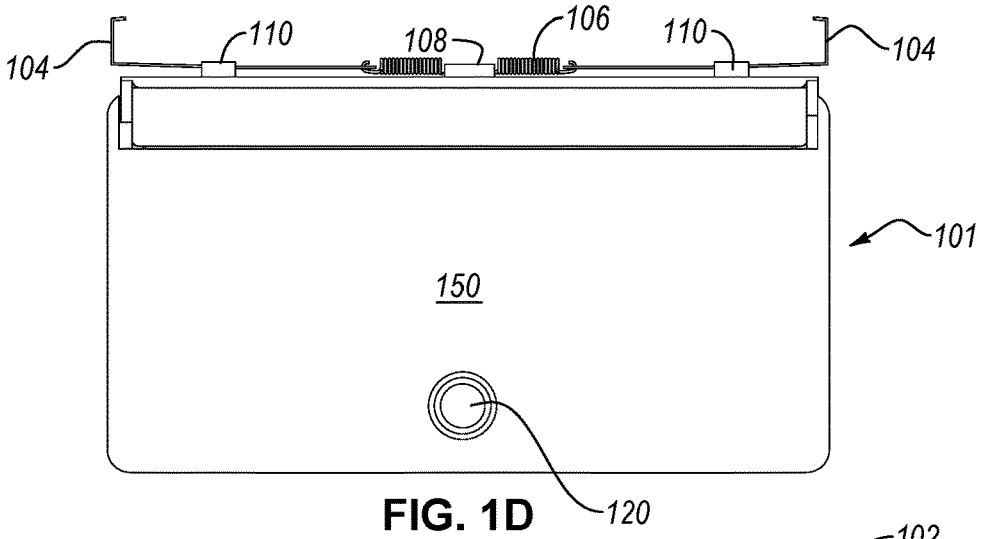
FIG. 1D depicts a top view of the storage box system of FIG. 1A.
Figure 1E:
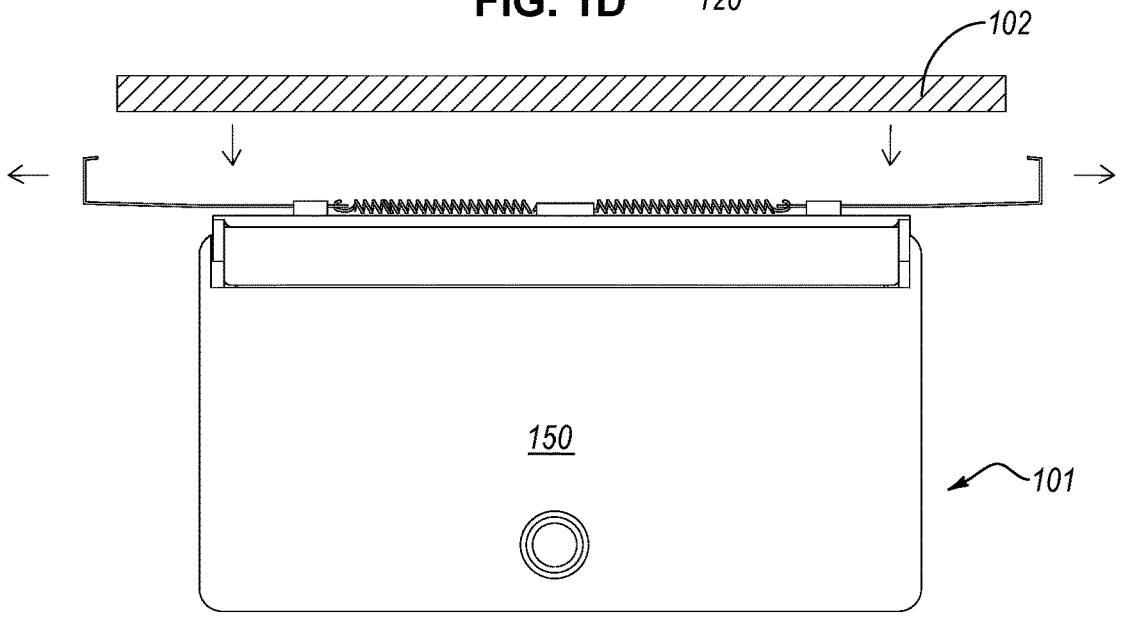
FIG. 1E depicts a top view of the storage box system of FIG. 1A.
Figure 1F:
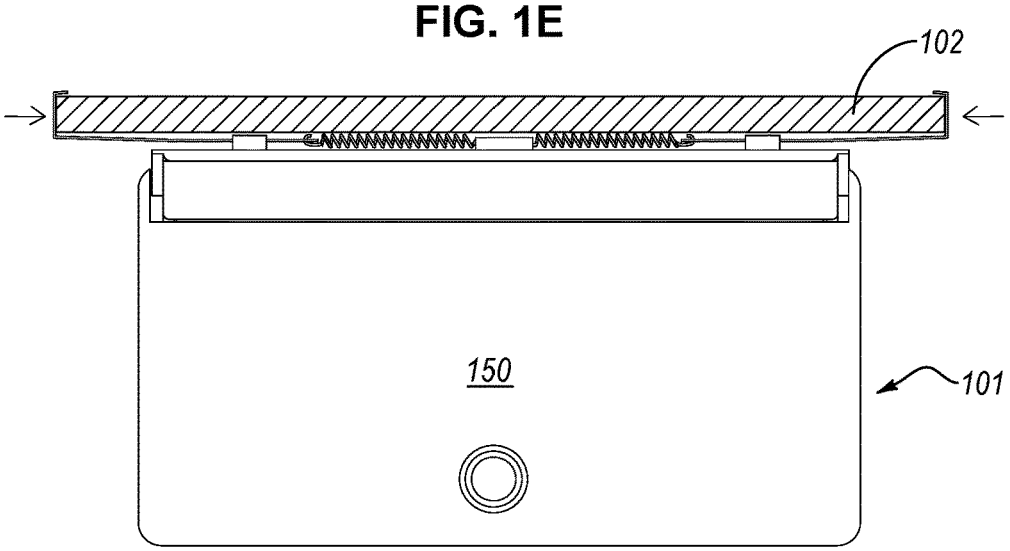
FIG. 1F depicts a top view of the storage box system of FIG. 1A.

FIGS. 1D-1F depicts a top view of the clamping arms 104 engaging the door 102. A shown, the springs 106 extend in a horizontal direction to allow the clamping arms 104 to engage the door 102. Thus, the clamping arms 104 may engage doors of different sizes.

Figure 2:
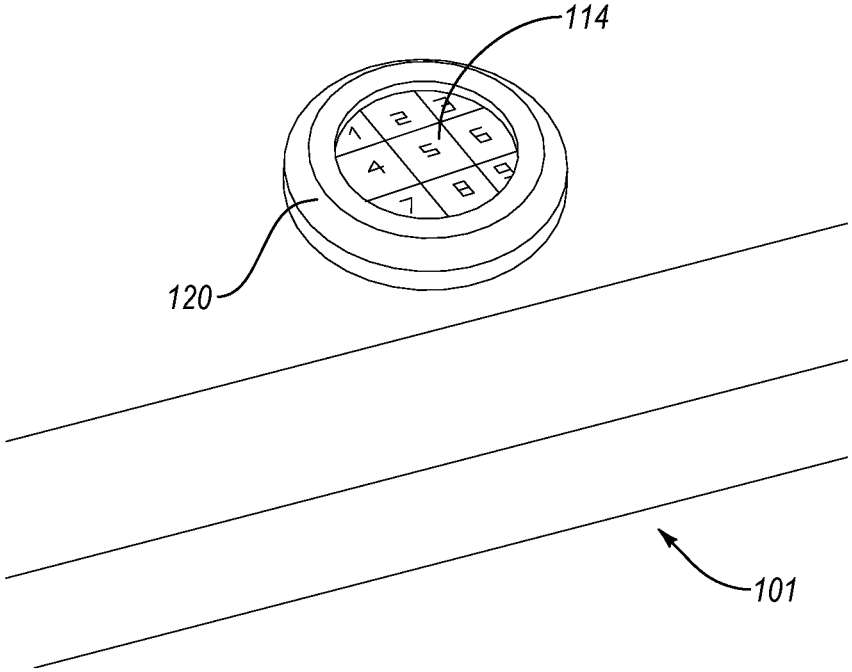
FIG. 2 depicts a partial perspective view of a locking device.

FIG. 2 depicts an embodiment of a locking device 120 that includes a touch screen pad 114 for unlocking the device manually. A delivery service may be informed of the code and use it to open the storage box 101. The locking device 120 may include any one of various conventional locking mechanisms including mechanical, electromechanical, and electromagnetic devices. In various embodiments, the locking device 120 may include a wireless interface to allow for Bluetooth, WiFi, and RFID communication and the like to enable remote unlocking of the storage box 101. Thus, a delivery service may use any number of electronic devices to remotely unlock the locking device 104. In one embodiment, a courier or delivery agent may use a smartphone or tablet (collectively referred to herein a portable electronic device) with an installed application to remotely unlock the storage box 101. In such an embodiment, the application may record each time a storage box 101 is unlocked 101 for confirmation. The application may further record the location of the portable electronic device when a storage box 101 is unlocked. As can be appreciated, The application may also require entry of a delivery agent's identification and password to further provide security. Thus, each time a storage box 101 is unlocked by a mobile app, the time of unlocking, identity of the delivery agent, and the location of the portable electronic device is recorded.

Figure 3A:
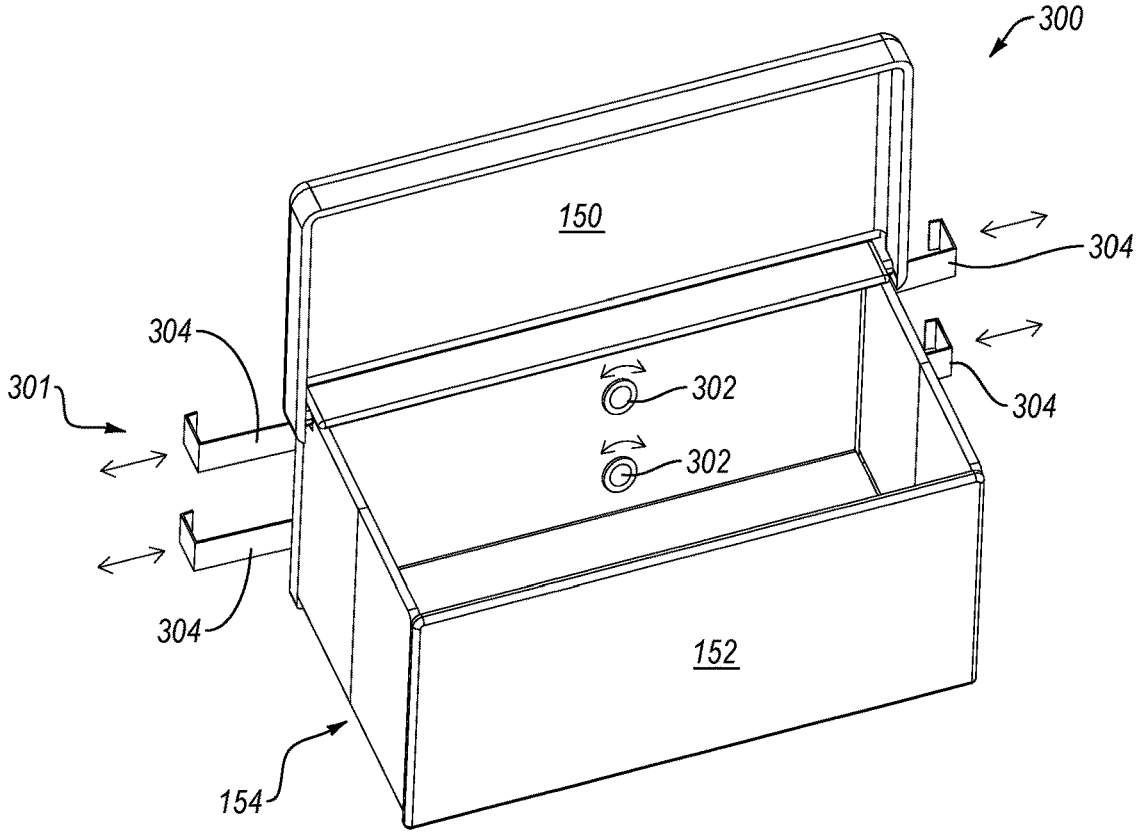
FIG. 3A depicts a front perspective view of an alternative embodiment of a storage box system.
Figure 3B:
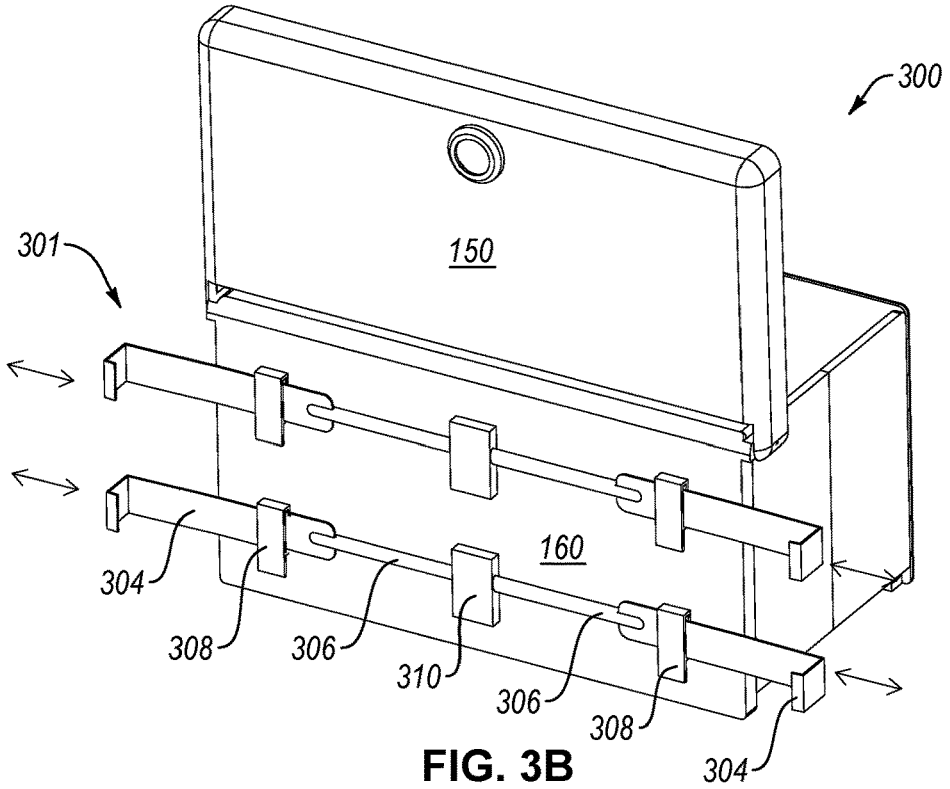
FIG. 3B depicts a rear view of the storage box system of FIG. 3A.

FIGS. 3A and 3B depict perspective views of an alternative embodiment of a storage box 300. The storage box 300 includes an alternative embodiment of a fastening mechanism 301. The fastening mechanism 301 includes one or more ratchet dials 302 that are disposed in the storage box interior. Each ratchet dial 302 turns clockwise and counter clockwise to horizontally extend or retract corresponding clamping arms 304. A ratchet dial 302 engages with a corresponding base 310 disposed on the back surface of the back wall 160. A base 310 supports, as illustrated, two ratchet arms 306 that extend horizontally and attach to corresponding clamping arms 304. Each clamping arm 304 may be supported by a guide 308 that is connected to the back wall 160.

Figure 4A:
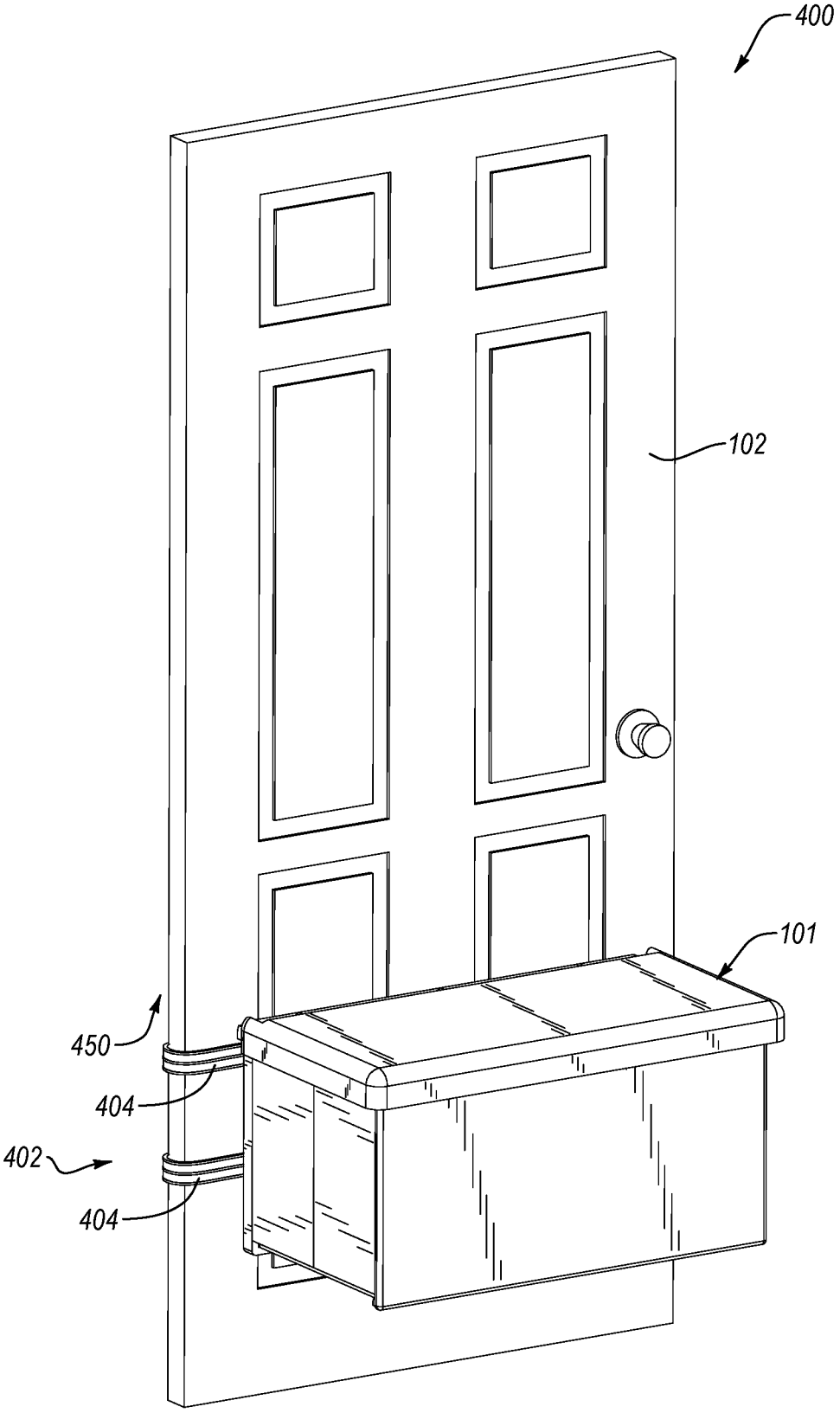
FIG. 4A depicts a perspective view of the storage box system of FIG. 3A attached to a door.
Figure 4B:
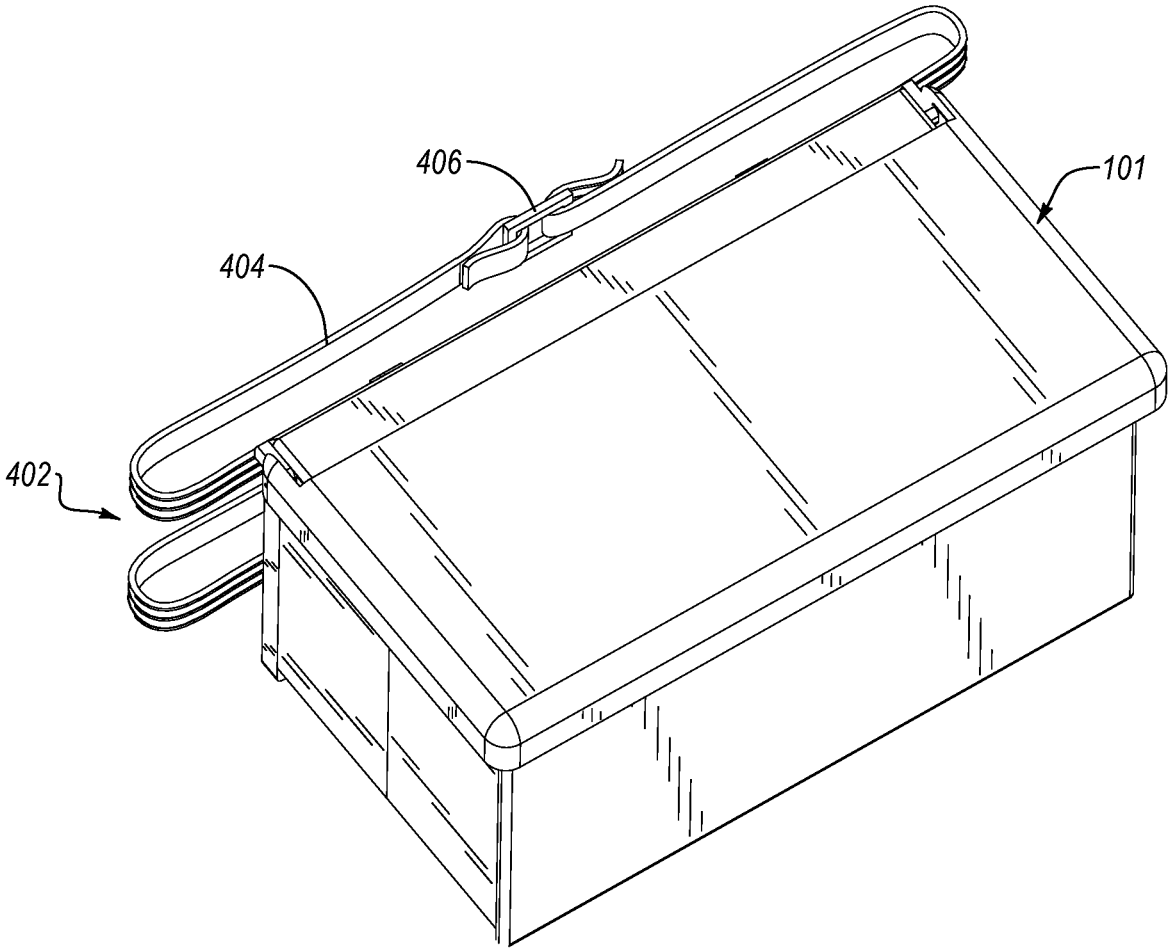
FIG. 4B depicts a perspective view of the storage box system of FIG. 3A.

FIGS. 4A and 4B depict an alternative embodiment of a storage box system 400 including a storage box 101 and a fastening mechanism 402. The fastening mechanism 402 may include a cable or strap 404. The cable 404 may include any one of various resilient and flexible materials. A cable 404 is secured to the back side of a back wall 160 and extends around a door 102. The cable 404 can be looped around the door 102 through a hinge slot 450 and secured to a buckle 406. The buckle 406 may be disposed on an opposing side of the door 102 and provides tension to hold the storage box 101 in place. The buckle 406 may be configured to enable adjustable tension in a corresponding cable 404. As illustrated, a fastening mechanism 402 may include two cables 404 to removably secure a storage box 101 to a door 102. In alternative embodiments, one, four, six or even eight cables may be used depending on the size of a storage box 101.

Figure 5:
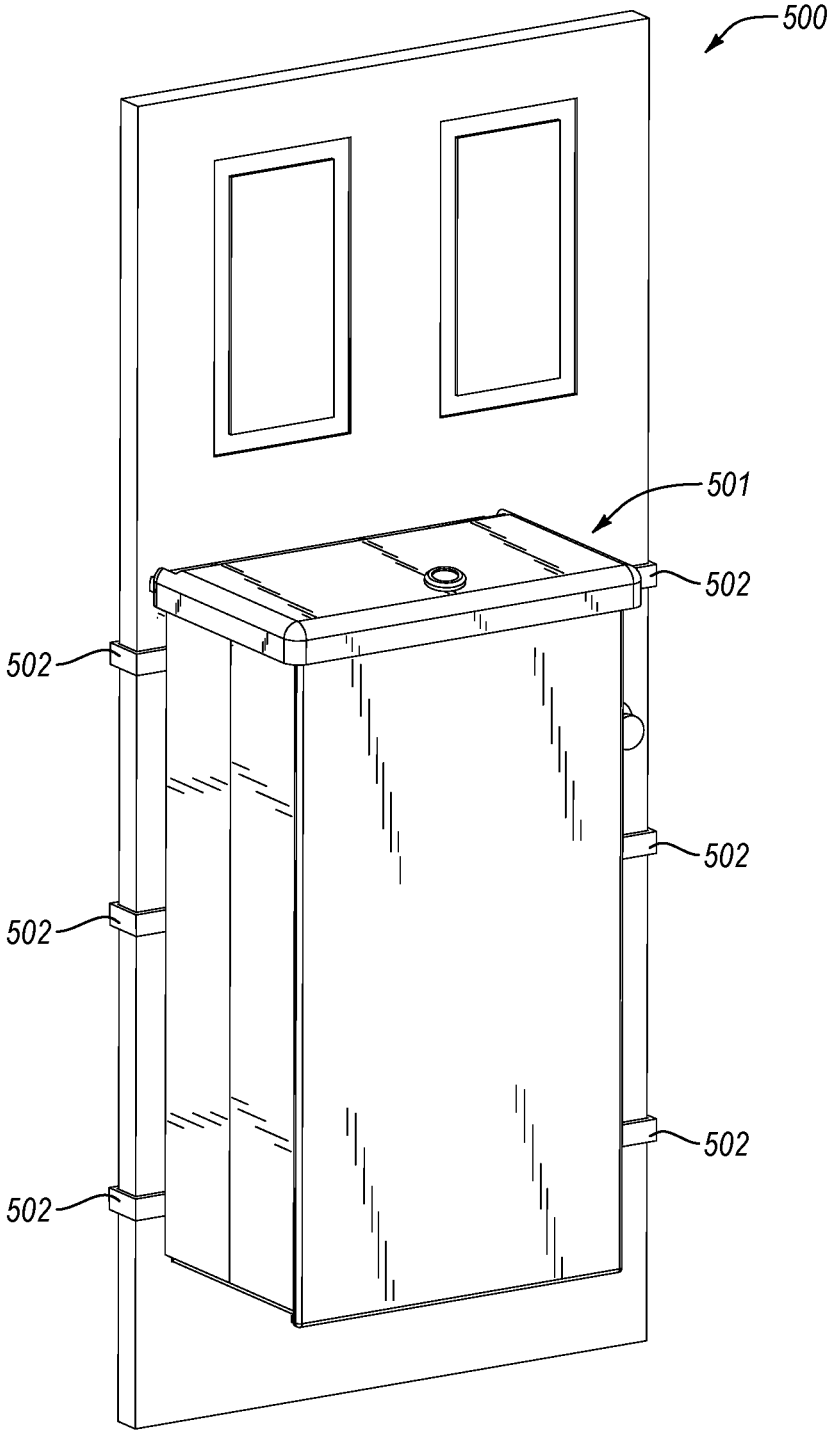
FIG. 5 depicts a perspective view of an alternative embodiment of a storage box system.

FIG. 5 depicts an alternative embodiment of a storage box system 500 with a storage box 501 removably attached to a door 102. The storage box 501 has a greater depth than storage box 101 to accommodate larger packages. The storage box 501 includes six clamping arms 502 to engage the door 102.

In FIGS. 6A to 6D, an alternative embodiment of a storage box system 600 is shown. A storage box 601 is integrated into a door 602. A back wall of the storage box 601 may secured to the door 602 by various fasteners, such as bolts, screws, rivets, and the like. Alternatively, a back wall may be secured to the door 602 by adhesives. Alternatively, the storage box 601 may not have a back wall and the sidewalls 604 are secured to the door 102. The door 602 itself may serve as the back wall.

Figure 6A:
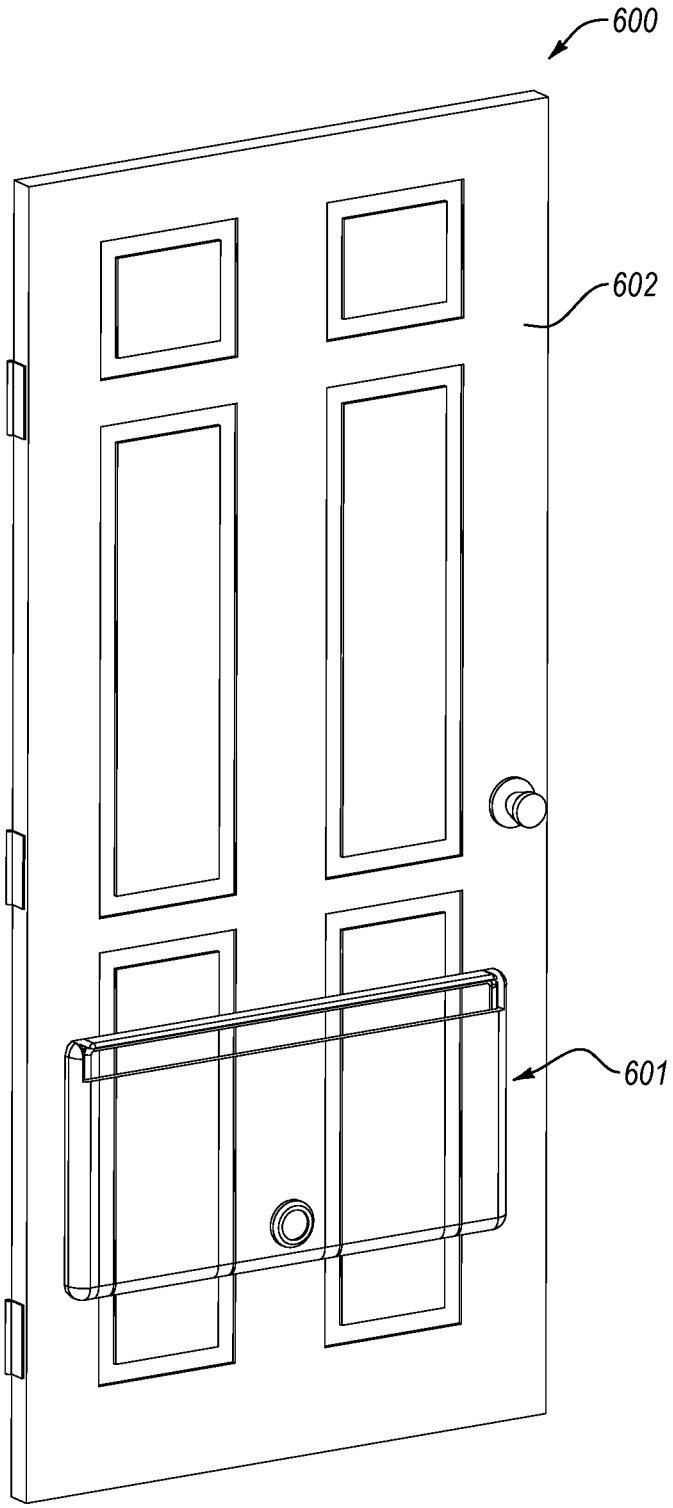
FIG. 6A depicts a perspective view of a door with a storage box system in a storage or folded position.
Figure 6B:
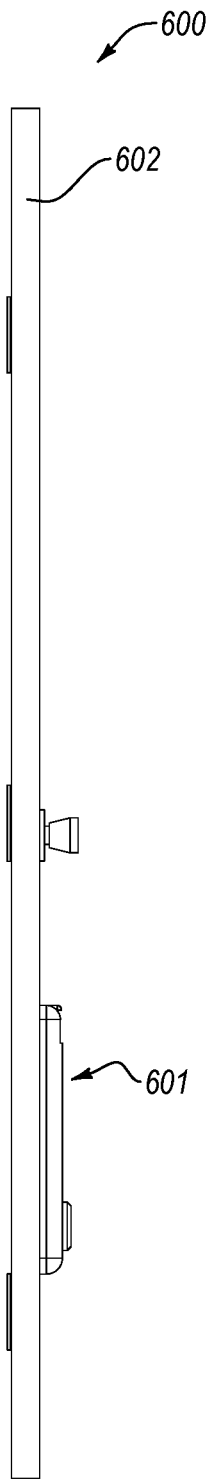
FIG. 6B depicts a side view of a door with storage box system of FIG. 6A in a storage or folded position.

In FIGS. 6A and 6B, the storage box 601 is shown in a storage configuration. As explained further below, the storage box 601 may be folded into a storage configuration to reduce space and obtrusiveness.

Figure 6C:
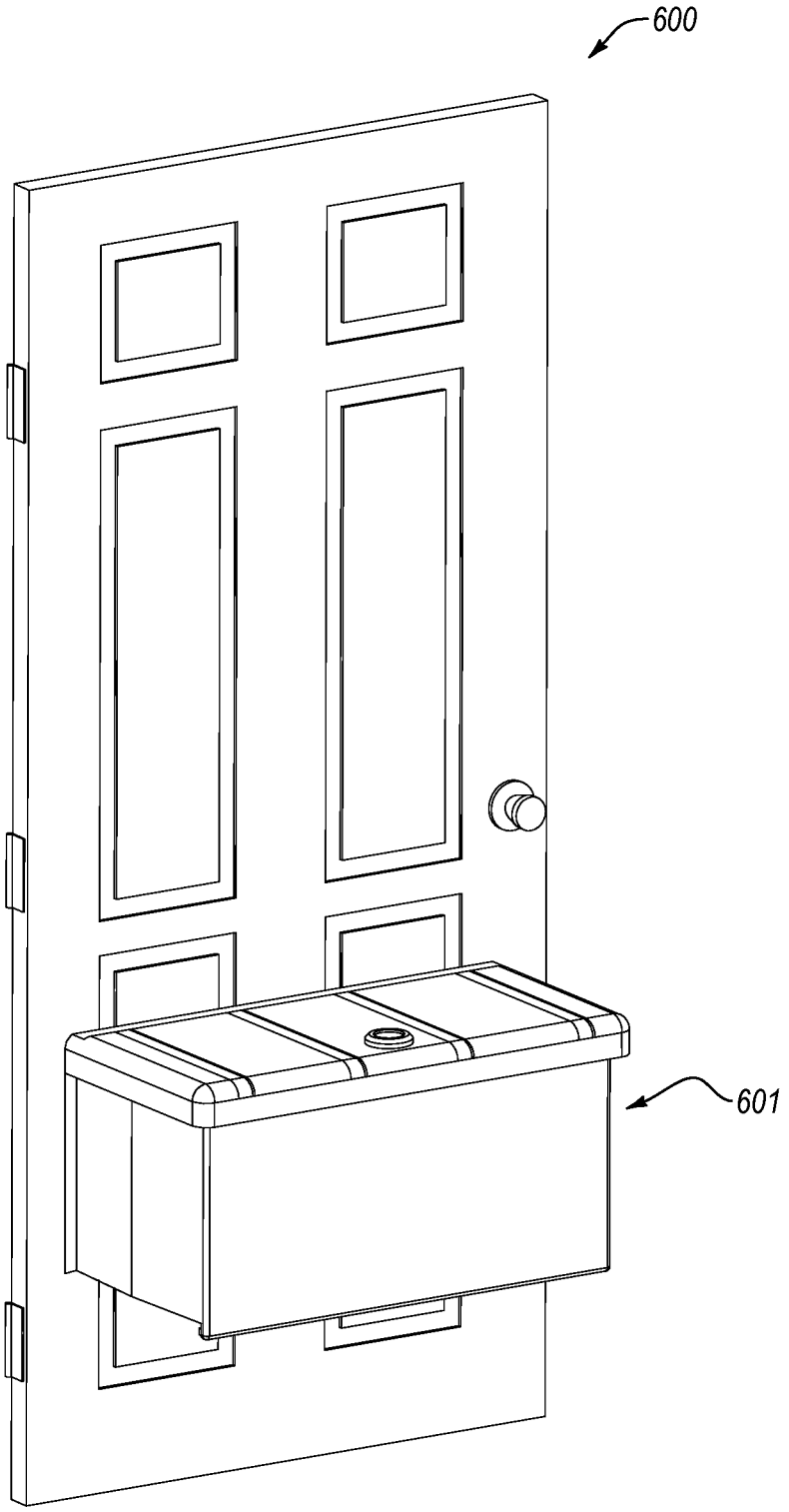
FIG. 6C depicts a perspective view of a door with a storage box system of FIG. 6A in an expanded position.
Figure 6D:
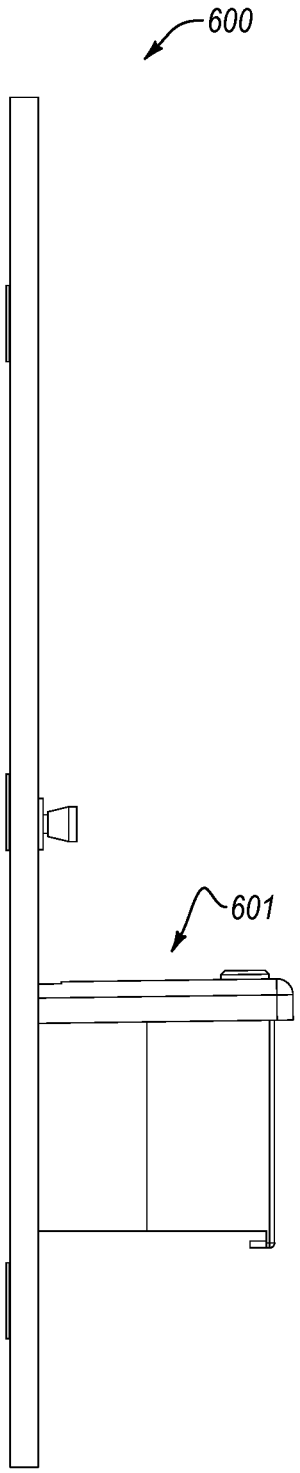
FIG. 6D depicts a side view of a door with a storage box system of FIG. 6A in an expanded position.

In FIGS. 6C and 6D, the storage box 601 is shown in an expanded configuration. In the expanded configuration, the storage box 601 defines an interior space that is ready to receive and securely store an object.

Figure 7A:
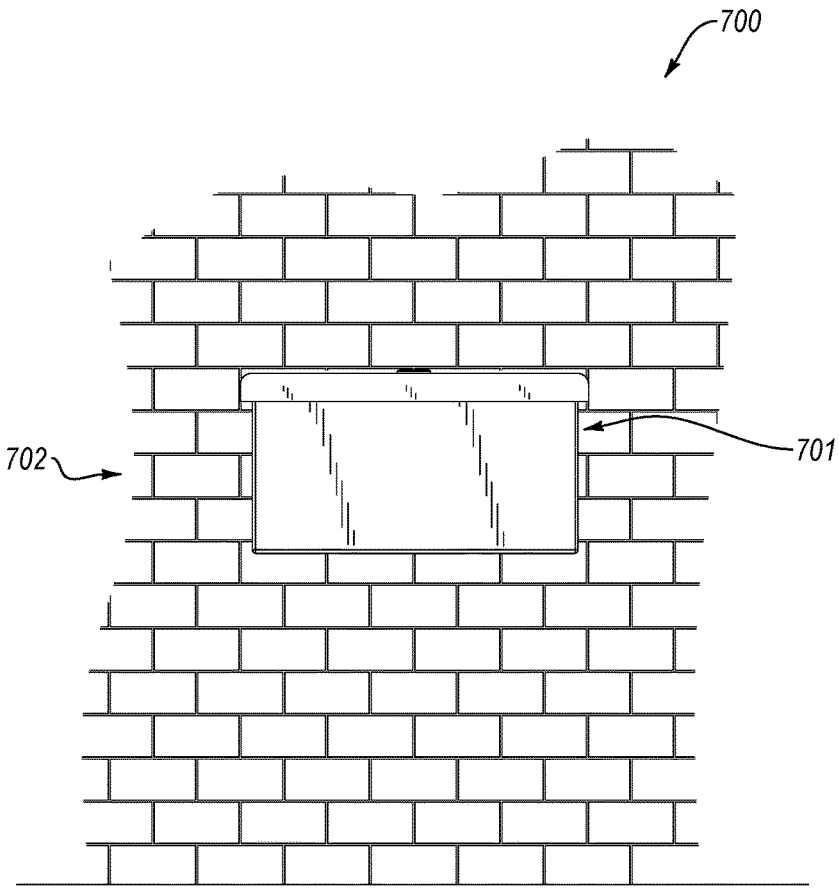
FIG. 7A depicts a front view of a storage box system in a storage or folded position and attached to a wall.
Figure 7B:
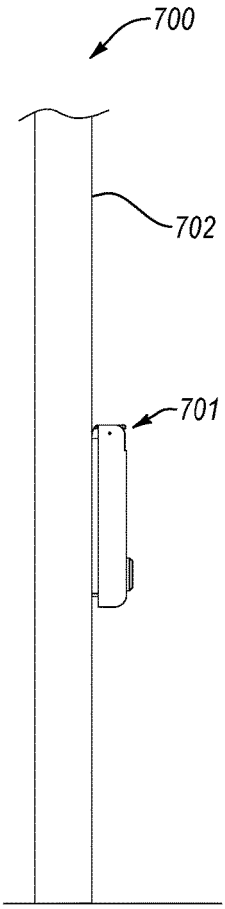
FIG. 7B depicts a side view of the storage box system of FIG. 7A in a storage or folded position.

In FIGS. 7A and 7B, an alternative embodiment of a storage box system 700 is shown. The storage box system 700 includes a storage box 701 that attaches to wall 702. The back wall of the storage box 701 may attach to the wall 702 by various conventional means including bolts, screws, rivets, or adhesives. In FIG. 7A, the storage box 701 is shown in an expanded configuration with an interior space ready to receive an object. In FIG. 7B, the storage box 701 is shown in a storage configuration wherein elements of the storage box are folded up and the interior space is eliminated.

Figure 8A:
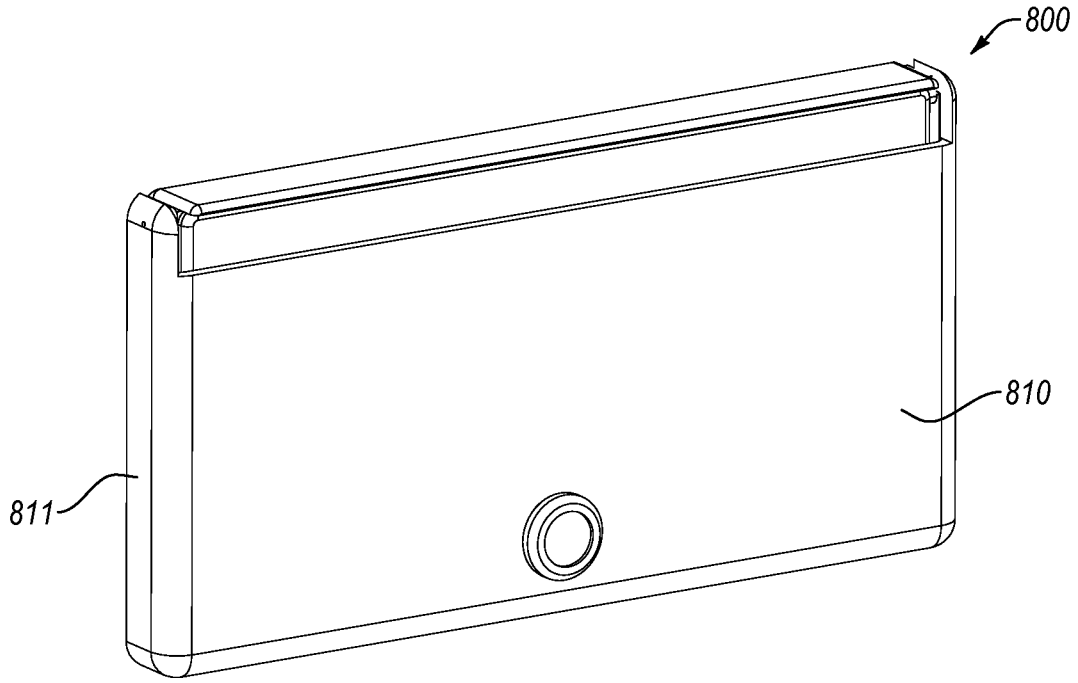
FIG. 8A depicts a top front perspective view of a storage box system in a storage or folded position.
Figure 8B:
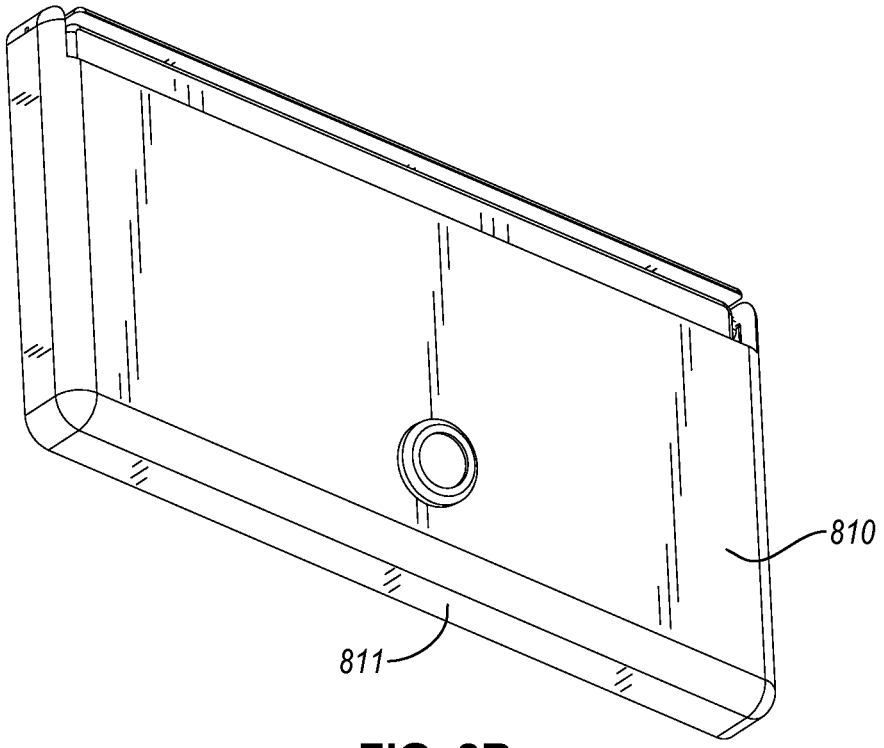
FIG. 8B depicts a bottom front perspective view of the storage box system of FIG. 8A in a storage or folded position.

In FIGS. 8A and 8B, an embodiment of a storage box 800 is shown in a storage or folded configuration. The storage box 800 includes a top wall or lid 810. The top wall 810 may include a border or lip 811 that partially extends around a perimeter of the top wall 810 and holds elements of the storage box 800 within.

Figure 8C:
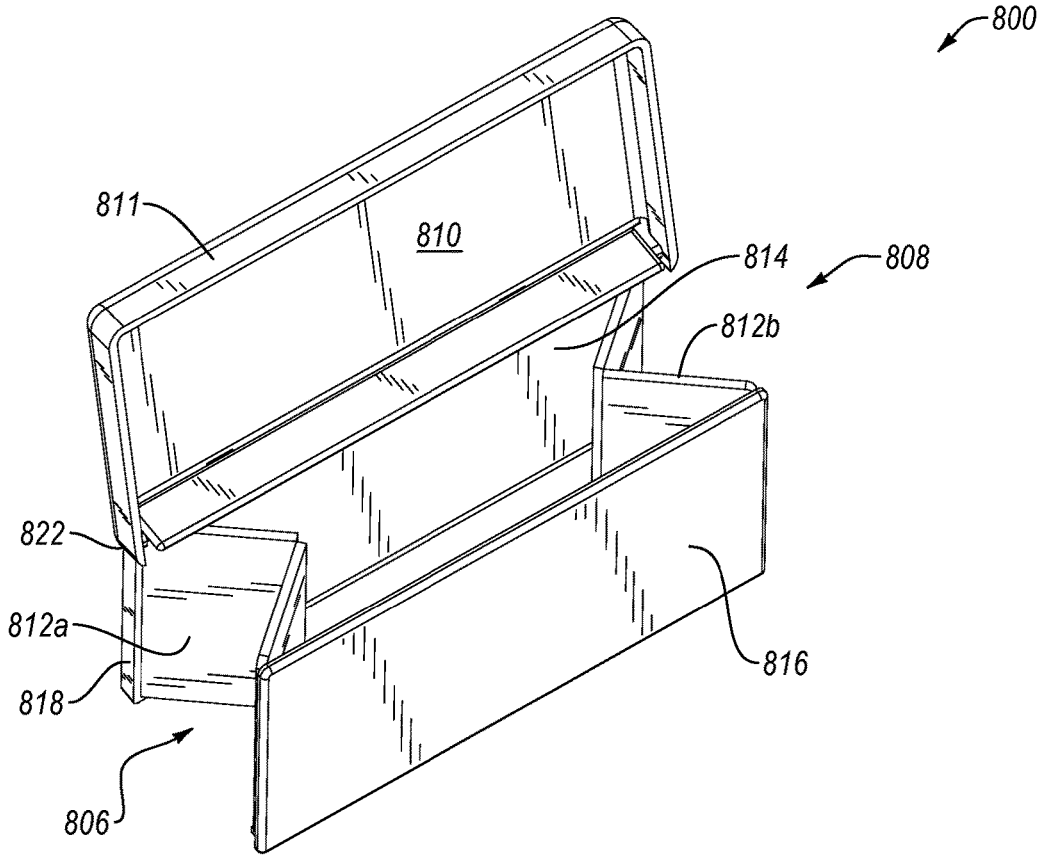
FIG. 8C depicts a top front perspective view of the storage box system of FIG. 8A in a partially opened position.
Figure 8D:
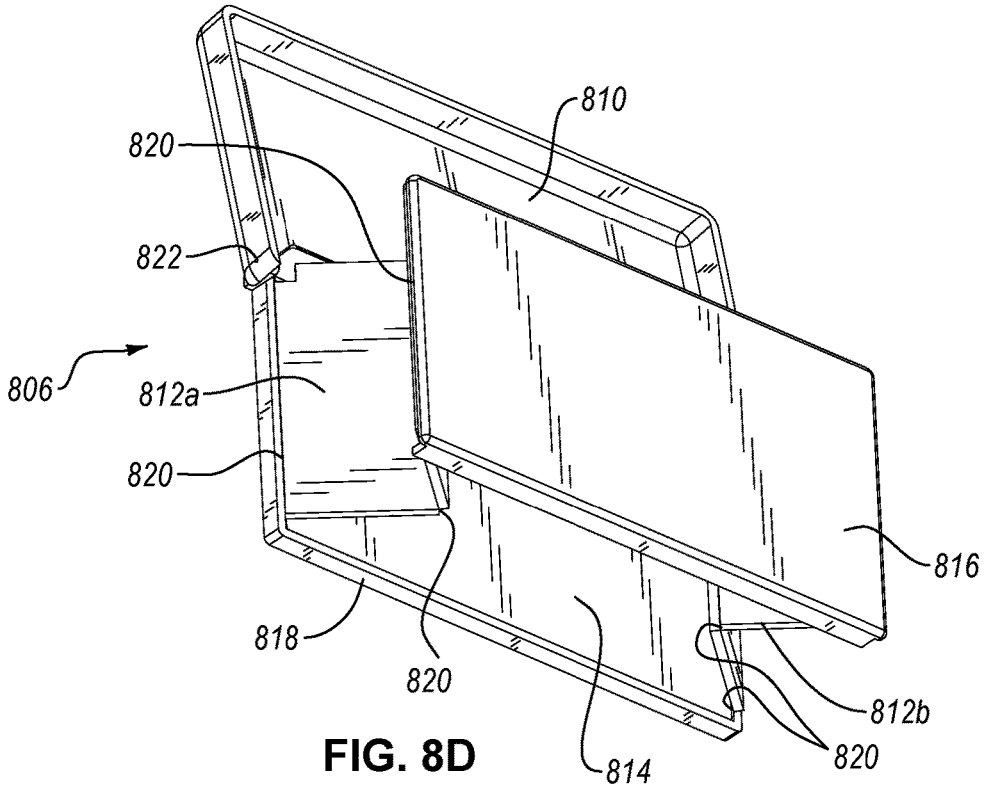
FIG. 8D depicts a bottom front perspective view of the storage box system of FIG. 8A in a partially opened position.

In FIGS. 8C and 8D, the storage box 800 is shown as it positions from a storage configuration to an expanded configuration. The top wall 810 is pivotally attached to a back wall 818 by a hinge 822. The hinge 822 may enable 180 degree pivotal rotation of the top wall 810 relative to the back wall 818. To transition from the storage configuration to the expanded configuration, the top wall 810 pivots upward. This enables access to first and second sidewalls 806, 808 and a front wall 816.

In the expanded configuration, the first and second sidewalls 806, 808 extend from the back wall 818 to the front wall 816. Each sidewall 806, 808 include first and second sidewall segments 812*a*, 812*b*. Each first sidewall segment 812*a* is pivotally attached to the back wall 818 and pivotally attached to a corresponding second sidewall segment 812*b*. Each second sidewall segment 812*b* is pivotally attached to a first sidewall segment 812*a* and pivotally attached to a front wall 816. The hinge lines 820 define pivotal movement between the back wall 818 and the first sidewall segment 812*a*, between the first sidewall segment 812*a* and the second sidewall segment 812*b*, and between the second sidewall segment 812*b* and the front wall 816.

In the storage configuration, a bottom wall 814 extends substantially parallel to the back wall 818, the front wall 816, and the top wall 810. In the storage configuration, the first and second sidewall segments 812*a*, 812*b* are substantially parallel to each other and also substantially parallel to the back wall 818, the front wall 816, and the top wall 810. The bottom wall 814 is pivotally attached to the back wall 818. As the sidewalls 806, 808 extend into the expanded configuration, there is increased space between the back wall 818 and the front wall 816. The increased space allows for the bottom wall 814 to pivot downward, away from the back wall 818, and complete a bottom surface of the storage box 800. In FIGS. 8C and 8D, the bottom wall 814 is still shown in the storage configuration and, as such, the bottom wall 814 is substantially parallel to the back wall 818.

The first and second sidewall segments 812*a*, 812*b* unfold along hinge lines 820 in a staggered direction creating flat side surfaces as the front wall 816 is pulled forward. The bottom wall 814 may stay in a vertical position until the side walls 806, 808 extend flush.

Figure 8E:
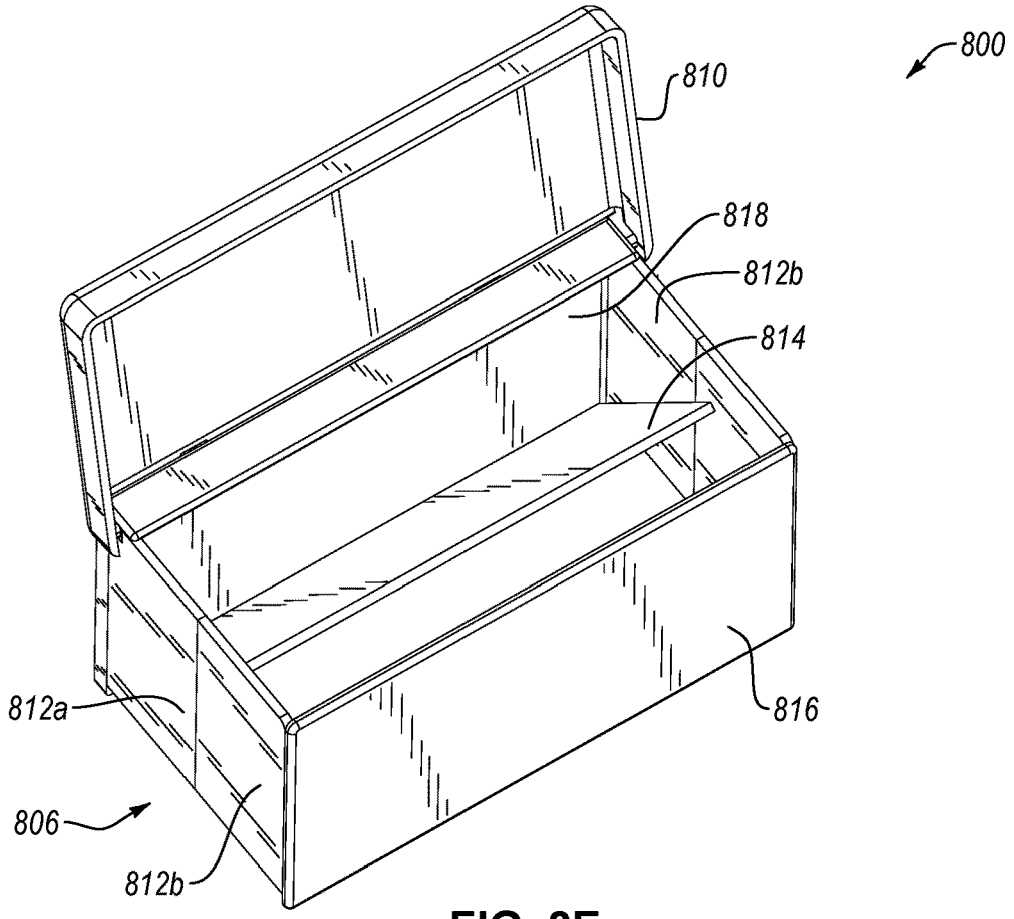
FIG. 8E depicts a top front perspective view of the storage box system of FIG. 8A in a partially expanded position.
Figure 8F:
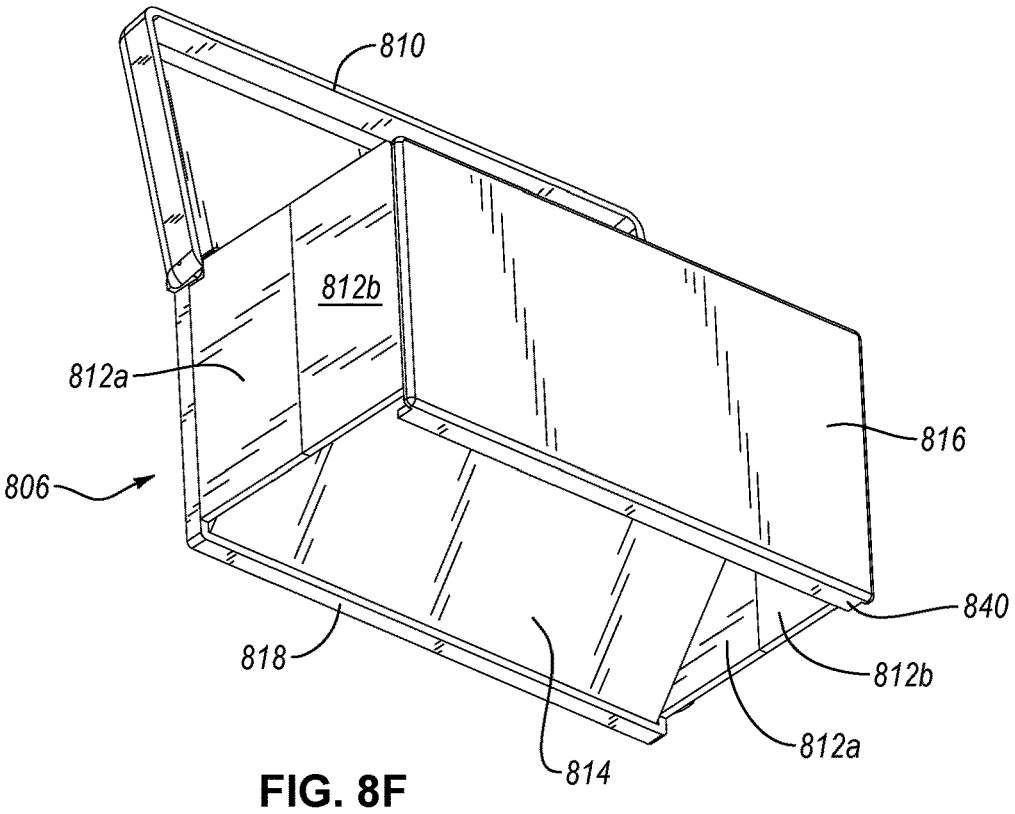
FIG. 8F depicts a bottom front perspective view of the storage box system of FIG. 8A in a partially expanded position.

In FIGS. 8E and 8F, the sidewalls 806, 808 are extended to their maximum length and the bottom wall 814 pivots outward to an expanded configuration. As such, the bottom wall 814 folds down to create a bottom of the storage box 800. In the expanded configuration, the bottom wall 814 may engage a bottom lip 840 which prevents further downward movement of the bottom wall 814. With the bottom wall 814 in the expanded configuration, the sidewalls 806, 808 are unable to fold into the storage box interior. Thus, movement of the sidewalls 806, 808 is prevented until the bottom wall 814 is The storage box 800 may include a bottom wall lock (not shown) that secures the bottom wall 814 into the expanded configuration. The bottom wall lock may include any one of various conventional mechanical locks to secure the bottom wall, such as latches, pins, springs, and the like. The bottom wall lock prevents access into the storage box interior by preventing vertical movement of the bottom wall 814. Release of the bottom wall lock is only available by accessing the storage box interior. Thus, release of the bottom wall lock requires unlocking the locking device 120 to enable pivotal movement of the top wall 810 and allow access to the storage box interior.

Figure 8G:
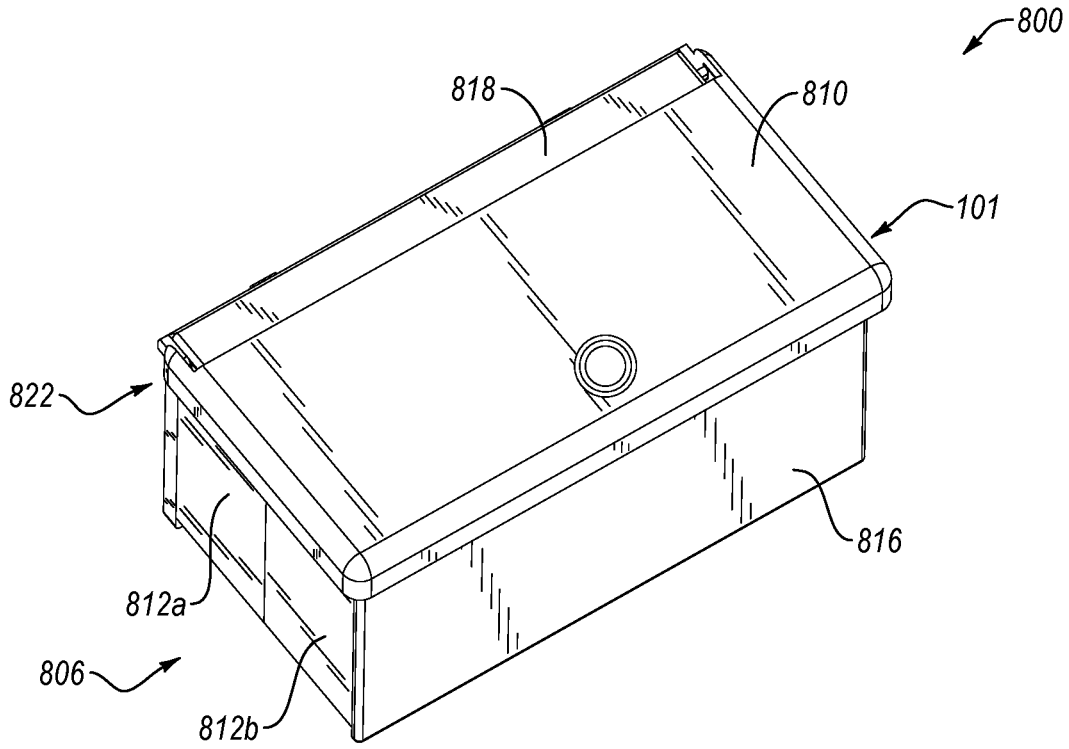
FIG. 8G depicts a top front perspective view of the storage box system of FIG. 8A in a fully expanded position.
Figure 8H:
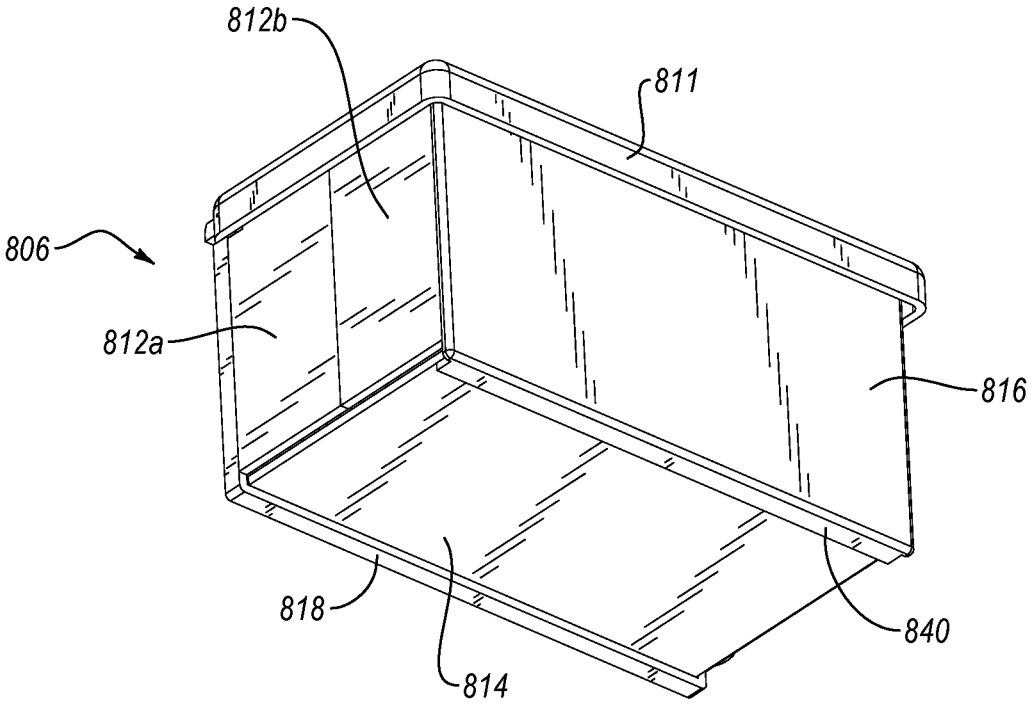
FIG. 8H depicts a bottom front perspective view of the storage box system of FIG. 8A in a fully expanded position.

In FIGS. 8G and 8H, the storage box 800 is shown in the expanded configuration with a full interior area. The top wall 810 pivots down, by use of the hinge 822, to engage the sidewalls 806, 808 and the front wall 816. As shown, the top wall border 811 extends around the sidewalls 806, 808 and the front wall 816. In the expanded configuration, the top wall 810, bottom wall 814, and first and second sidewalls 806, 808 are substantially perpendicular to the back wall 818 and front wall 816. The locking device 120 secures the top wall 810 relative to the front wall 816 to prevent access to the storage box interior. By unlocking the locking device 120, the top wall 810 may pivot upward and access to the storage box interior is enabled.

Transition of the storage box 800 from the expanded configuration to the storage configuration is accomplished by reversing the actions shown in FIGS. 8A-8H.

Terminology, descriptions, numbers, and labels used herein with the different embodiments illustrated in the Figures are for purpose of explanation and not limitation. A term, description, number, or label used and illustrated in one embodiment may also be used in another embodiment. Thus, for example, any one of the fastening mechanisms shown in FIGS. 1A-4B, may be used for the storage box 800 of FIGS. 8A-8H. A structural feature described in FIG. 8F, such as the bottom wall lip 840 may be used in the embodiments shown in earlier Figs. such as FIGS. 1A-7B. Thus, a structural element is not limited to only the illustrated embodiment.

While preferred materials for elements have been described, the device is not limited by these materials. Wood, plastics, rubber, foam, metal alloys, aluminum, and other materials may comprise some or all of the elements of the devices and apparatuses in various embodiments of the present invention.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and the scope of the present invention, are contemplated thereby, and are intended to be covered by the following claims.

What is claimed is:

1. A storage box system to receive and retain an object, comprising:
- a back wall;
- a top wall pivotally attached to the back wall;
- a bottom wall pivotally attached to the back wall;
- a front wall;
- a first sidewall pivotally attached to the back wall and pivotally attached to the front wall;
- a second sidewall pivotally attached to the back wall and pivotally attached to the front wall;
- wherein the first sidewall and the second sidewall each include,
  - a first sidewall segment pivotally attached to the back wall, and
  - a second sidewall segment pivotally attached to the first sidewall segment and pivotally attached to the front wall;
- a fastening mechanism attached to the back wall to secure the back wall to an external structure, the fastening mechanism including,
  - a plurality of clamping arms to engage a door; and
  - a plurality of springs, wherein each spring is attached to a corresponding clamping arm; and
- a locking device disposed on the top wall to secure the position of the top wall relative to the front wall;
- wherein the top wall, bottom wall and first and second sidewalls transition from a storage configuration with the back wall, top wall, bottom wall, and first and second sidewall segments substantially parallel to each other, to an expanded configuration with the top wall, bottom wall, and first and second sidewalls substantially perpendicular to the back wall and front wall.

2. The storage box system of claim 1, wherein the locking device includes a keypad.

3. The storage box system of claim 1, wherein the locking device includes a wireless interface.

4. The storage box system of claim 1, further comprising a wireless camera.

5. The storage box system of claim 1, further comprising a bottom wall lock to engage the bottom wall and secure the position of the bottom wall in the expanded configuration.

6. The storage box system of claim 1, wherein the top wall includes a border that partially extends around a perimeter of the top wall and at least partially covers the first and second sidewalls and the front wall.

7. A storage box system to receive and retain an object, comprising:
- a storage box configured to transition from an expanded configuration, wherein an interior area is defined, and a storage configuration, wherein the interior area is eliminated, the storage box including;
  - a back wall;
  - a top wall pivotally coupled to the back wall;
  - a bottom wall pivotally coupled to the back wall;
  - a front wall;
  - a first sidewall pivotally coupled to the back wall and pivotally coupled to the front wall;
  - a second sidewall pivotally coupled to the back wall and pivotally coupled to the front wall;
  - wherein the first sidewall and the second sidewall each include,
    - a first sidewall segment pivotally coupled to the back wall, and
    - a second sidewall segment pivotally coupled to the first sidewall segment and pivotally coupled to the front wall;
  - a locking device disposed on the top wall to secure the position of the top wall relative to the front wall;
  - wherein in the storage configuration, the top wall, bottom wall, and first and second sidewall segments are substantially parallel to each other,
  - wherein in an expanded configuration the top wall, bottom wall, and first and second sidewalls are substantially perpendicular to the back wall and front wall to define the interior area; and
- a fastening mechanism coupled to the back wall and configured to expand and retract to couple to doors of various sizes, the fastening mechanism including,
  - a plurality of clamping arms to engage a door;
  - a plurality of ratchet arms, wherein each ratchet arm is attached to a corresponding clamping arm; and
  - a ratchet dial to engage the ratchet arms and control movement of the ratchet arms.

8. The storage box system of claim 7, wherein the locking device includes a keypad.

9. The storage box system of claim 7, wherein the locking device includes a wireless interface.

10. The storage box system of claim 7, further comprising a wireless camera.

11. The storage box system of claim 7, further comprising a bottom wall lock to engage the bottom wall and secure the position of the bottom wall in the expanded configuration.

12. The storage box system of claim 7, wherein the top wall includes a border that partially extends around a perimeter of the top wall and at least partially covers the first and second sidewalls and the front wall.

13. The storage box system of claim 7, further comprising a bottom wall lip, coupled to the front wall, and configured to limit pivotal movement of the bottom wall.

* * * * *